US010699640B2

(12) United States Patent
Zhou et al.

(10) Patent No.: US 10,699,640 B2
(45) Date of Patent: Jun. 30, 2020

(54) METHOD FOR DRIVING PIXEL CIRCUIT

(71) Applicant: SHANGHAI TIANMA MICRO-ELECTRONICS CO., LTD., Shanghai (CN)

(72) Inventors: Xingyao Zhou, Shanghai (CN); Yuan Li, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 5 days.

(21) Appl. No.: 15/960,367

(22) Filed: Apr. 23, 2018

(65) Prior Publication Data

US 2018/0240400 A1 Aug. 23, 2018

(30) Foreign Application Priority Data

Nov. 21, 2017 (CN) ..... 2017 1 1167099

(51) Int. Cl.
*G09G 3/325* (2016.01)
*G09G 3/3233* (2016.01)

(52) U.S. Cl.
CPC ..... *G09G 3/325* (2013.01); *G09G 3/3233* (2013.01); *G09G 2300/0819* (2013.01); *G09G 2300/0842* (2013.01); *G09G 2300/0861* (2013.01); *G09G 2310/0262* (2013.01); *G09G 2310/08* (2013.01); *G09G 2320/0233* (2013.01); *G09G 2320/0257* (2013.01); *G09G 2320/045* (2013.01)

(58) Field of Classification Search
CPC combination set(s) only.
See application file for complete search history.

(56) References Cited

U.S. PATENT DOCUMENTS 9,330,601 B2 5/2016 Lee et al.
2016/0321990 A1* 11/2016 Kim ..... G09G 3/3233

FOREIGN PATENT DOCUMENTS

CN 106652915 A 5/2017
CN 107274830 A 10/2017

* cited by examiner

*Primary Examiner* — Robin J Mishler
(74) *Attorney, Agent, or Firm* — Alston & Bird LLP

(57) ABSTRACT

A method for driving a pixel circuit is disclosed. The method includes: a time for displaying a frame including N initialization phases and N data signal voltage writing phases before a light-emitting phase. The ith of the N data signal voltage writing phases is after the ith of the N initialization phases and before the (i+1)th of the N initialization phases, and the Nth data signal voltage writing phase is after the Nth initialization phase, $1 \leq i \leq N-1$, i is an integer and N is an integer greater than 1. In the initialization phase, an initialization voltage is applied to the gate electrode of the driving transistor by the initialization module. In the data signal voltage writing phase, a data signal voltage is applied to the gate electrode of the driving transistor by the data signal voltage writing module.

10 Claims, 12 Drawing Sheets

METHOD FOR DRIVING PIXEL CIRCUIT

CROSS-REFERENCES TO RELATED APPLICATIONS

This application claims priority to Chinese patent application No. CN201711167099.4, filed on Nov. 21, 2017, the disclosure of which is incorporated herein by reference in its entirety.

TECHNICAL FIELD

Embodiments of the present disclosure relate to the field of display technology, and, in particular, relate to a method for driving a pixel circuit.

BACKGROUND

Compared with liquid crystal displays, organic light-emitting displays (OLED) have advantages such as low production cost, low energy consumption, self-luminescence, wide viewing angle and fast response, and are currently widely used in the display fields such as mobile phones, personal digital assistants and digital cameras. An organic light-emitting display panel is provided with a plurality of pixel circuits.

The pixel circuit generally includes a driving transistor, one or more switching transistors, and a storage capacitor. A driving current generated by the driving transistor drives an organic light emitting element to emit light for displaying an image. When pixels display a large number of frames of black image, the driving transistor is turned off for a long time. In this case, a gate electrode of the driving transistor is at a high electric potential, so a positive bias voltage is applied to the driving transistor for a long time, and a threshold voltage drifts. After switching to a white image, since the threshold voltage of the driving transistor cannot be recovered in time, that is, a hysteresis effect of the driving transistor, the display brightness of the first frame of white image is low and the display effect is poor.

SUMMARY

Embodiments of the present disclosure provide a method for driving a pixel circuit for alleviating the hysteresis effect of the driving transistor, solving the problem that the brightness at the beginning time when switching from a black image to a white image in the display process cannot reach the target brightness, and improving the display effect.

In view of this, an embodiment of the present disclosure provides a method for driving a pixel circuit. The pixel circuit includes a light-emitting element, a driving transistor, an initialization module, a data signal voltage writing module and a storage module for maintaining a voltage of a gate electrode of the driving transistor.

Time for displaying a frame includes a light-emitting phase, and N initialization phases and N data signal voltage writing phases before the light-emitting phase. The ith data signal voltage writing phase is after the ith initialization phase and before the (i+1)th initialization phase, and the Nth data signal voltage writing phase is after the Nth initialization phase, $1 \le i \le N-1$, i is an integer and N is an integer greater than 1.

The driving method includes the following steps.

Applying an initialization voltage to the gate electrode of the driving transistor in each of the N initialization phases by the initialization module.

Applying a data signal voltage to the gate electrode of the driving transistor in each of the N data signal voltage writing phases by the data signal voltage writing module.

Generating a driving current for driving the light-emitting element to emit light in the light-emitting phase by the driving transistor.

According to the present disclosure, the time for displaying a frame includes a light-emitting phase, and N initialization phases and N data signal voltage writing phases before the light-emitting phase, where the ith data signal voltage writing phase is after the ith initialization phase and before the (i+1)th initialization phase, and the Nth data signal voltage writing phase is after the Nth initialization phase, $1 \le i \le N-1$, i is an integer and N is an integer greater than 1. In each of the initialization phases, an initialization voltage is applied to the gate electrode of the driving transistor by the initialization module. In each of the N data signal voltage writing phases, a data signal voltage is applied to the gate electrode of the driving transistor by the data signal voltage writing module. In the light-emitting phase, a driving current for driving the light-emitting element to emit light is generated by the driving transistor. That is, in the time for displaying a frame, initializing and then applying the data signal voltage are repeated for N times, making a large current to flow through the driving transistor for N times.

BRIEF DESCRIPTION OF DRAWINGS

To illustrate technical solutions in related art or embodiments of the present disclosure more clearly, the accompanying drawings used in descriptions of the embodiments or the related art will be briefly described below. Apparently, the accompanying drawings described below illustrate part of embodiments of the present disclosure, and those of ordinary skill in the art may obtain other accompanying drawings based on the accompanying drawings described below on the premise that no creative work is done.

DETAILED DESCRIPTION

The present disclosure will be further described in detail below with reference to the accompanying drawings and embodiments. It should be understood that the specific embodiments described herein are merely used for explaining the present disclosure rather than for limiting the present disclosure. In addition, it should also be noted that, for the convenience of description, only some structures related to the present disclosure but not all structures are shown in the accompanying drawings.

An embodiment of the present disclosure provides a method for driving a pixel circuit. The pixel circuit includes a light-emitting element, a driving transistor, an initialization module, a data signal voltage writing module, and a storage module.

The method for driving the pixel circuit includes the following steps.

The time for displaying a frame includes N initialization phases and N data signal voltage writing phases before a light-emitting phase. The ith data signal voltage writing phase is after the ith initialization phase and before the (i+1)th initialization phase and the Nth data signal voltage writing phase is after the Nth initialization phase, where $1 \leq i \leq N-1$, i is an integer and N is an integer greater than 1.

In each of the initialization phases, an initialization voltage applied to a gate electrode of the driving transistor by the initialization module.

In each of the data signal voltage writing phases, a data signal voltage is applied to the gate electrode of the driving transistor by the data signal voltage writing module.

The storage module is configured to maintain a gate voltage of the driving transistor.

In the light emitting phase, the driving transistor generates a driving current that drives the light-emitting element to emit light.

Figure 1:
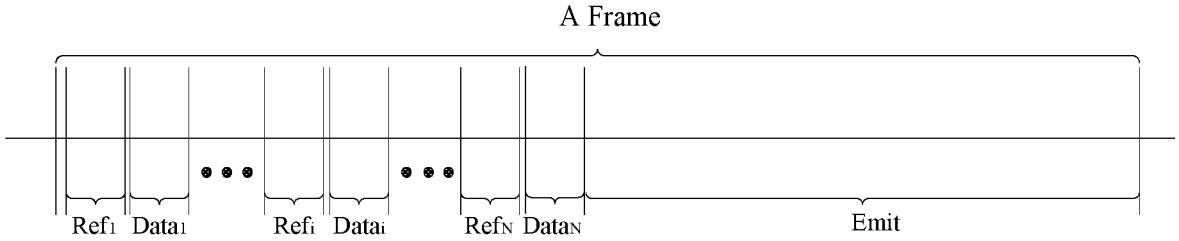
FIG. 1 is a schematic diagram of a driving time cycle according to an embodiment of the present disclosure.

Exemplarily, FIG. 1 is a schematic diagram of a driving period according to an embodiment of the present disclosure. With reference to FIG. 1, the time for displaying one frame of image includes N initialization phases $Ref_1$ to $Ref_N$ and N data signal voltage writing phases $Data_1$ to $Data_N$ before a light-emitting phase Emit. The ith data signal voltage writing phase $Data_1$ is after the ith initialization phase $Ref_1$ and before the (i+1)th initialization phase $Ref_{i+1}$, and the Nth data signal voltage writing phase $Data_N$ is after the Nth initialization phase $Ref_N$, where $1 \leq i \leq N-1$, i is an integer, and N is an integer greater than 1, that is, the minimum value of N is 2, and that is, the time for displaying one frame of image may include at least 2 initialization phases and 2 data signal voltage writing phases before the light-emitting phase. The time for displaying one frame of image may include multiple initialization phases and multiple data signal voltage writing phases before the light-emitting phase, the number of the initialization phases and the number of the data signal voltage writing phases may be configured according to the actual need of the pixel circuit, which is not limited herein.

In the initialization phase, an initialization voltage is applied to a gate electrode of the driving transistor by the initialization module. In the data signal voltage writing phase, a data signal voltage is applied to the gate electrode of the driving transistor by the data signal voltage writing module. In the light emitting phase, the driving transistor generates, according to the data signal voltage applied to the gate electrode thereof, a corresponding driving current that drives the light-emitting element to emit light. Meanwhile, the storage module maintains the voltage of the gate electrode of the driving transistor, such that the driving transistor generates the driving current to driving the light emitting element for emitting light.

Figure 2:
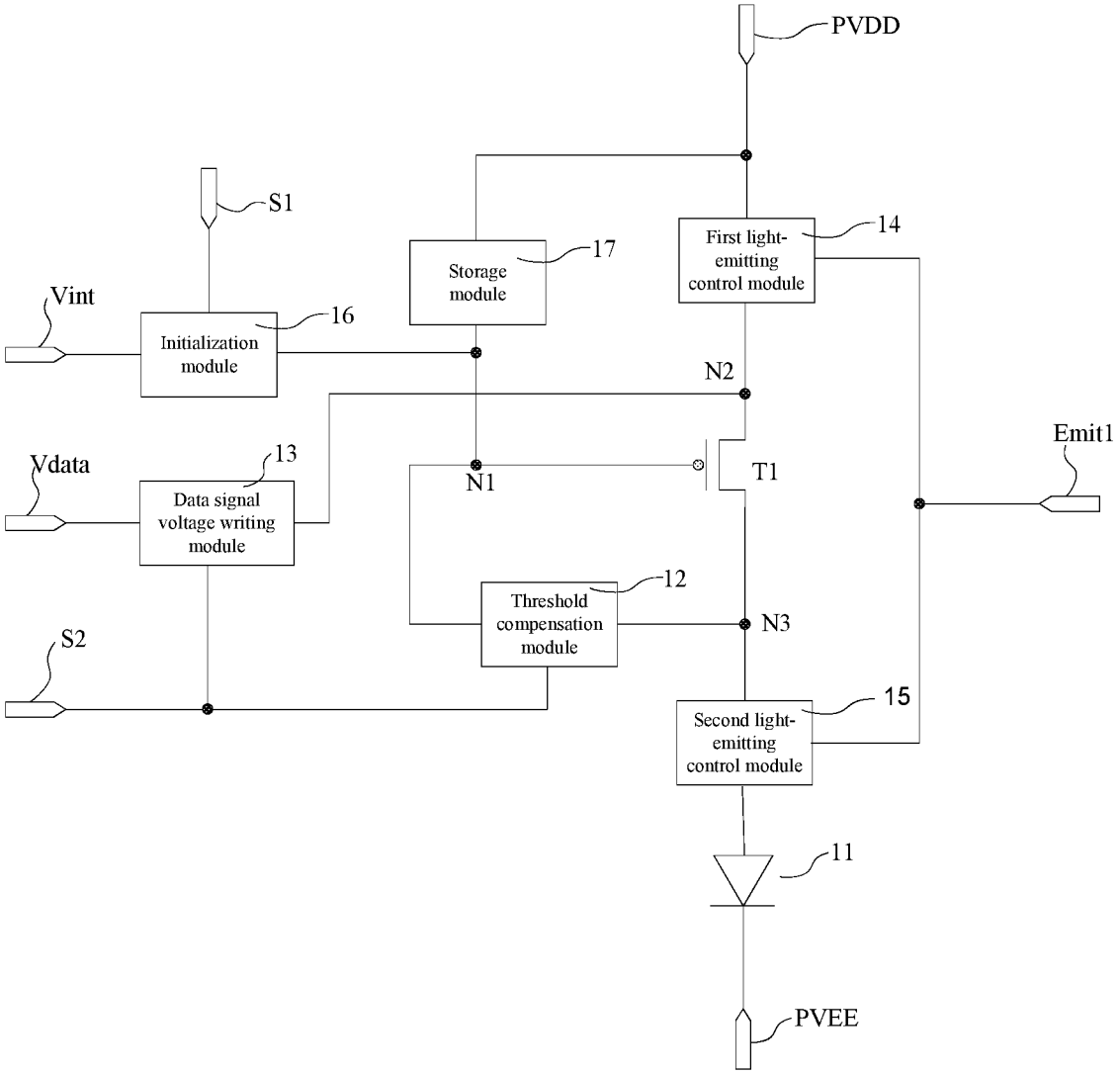
FIG. 2 is a circuit diagram of a pixel circuit according to related art.

Exemplarily, FIG. 2 is a circuit diagram of a pixel circuit according to related art. With reference to FIG. 2, a first electrode of a data signal voltage writing module 13 is electrically connected to a data line Vdata, and a second electrode is electrically connected to a first electrode of a driving transistor T1. A first electrode of a first light-emitting control module 14 is electrically connected to a first power voltage signal line PVDD, and a second electrode is electrically connected to the first electrode of the driving transistor T1. A first electrode of an initialization module 16 is electrically connected to an initialization voltage signal line Vint, and a second electrode is electrically connected to a gate electrode of the driving transistor T1. A first electrode of a storage module 17 is electrically connected to the gate electrode of the driving transistor T1, and a second electrode of the storage module 17 is electrically connected to the first power voltage signal line PVDD. A first electrode of a light-emitting element 11 is electrically connected to a second electrode of the driving transistor T1 through a second light-emitting control module 15, and a second electrode of the light-emitting element 11 is electrically connected to a second power voltage signal line PVEE. A frame of such pixel circuit only includes one initialization phase and one data signal voltage writing phase. A simulation is performed with respect to this pixel circuit. In the simulation, the (n−1)th frame is a grayscale of 0, the nth frame is a grayscale of 255 and the (n+1)th frame is a grayscale of 255. Electric potentials of a first node N1 and electric potentials of a second node N2 at different times are detected, and the detection result is shown in the following table.

TABLE 1

| Grayscale | Frame No. | Phase | N1 (V) | N2 (V) |
|---|---|---|---|---|
| 0 | (n−1)th frame | light-emitting phase | 3.44 | 4.6 |
| 255 | nth frame | initialization phase | −3 | −0.65 |
| | | data writing phase | 1.03 | 3.5 |
| | | light-emitting phase | 1.5 | 4.6 |
| 255 | (n+1)th frame | initialization phase | −3 | 0.15 |
| | | data writing phase | 1.02 | 3.5 |

As seen from the above table 1, in the initialization phase, the electric potential of the second node N2 in the nth frame is different from the electric potential of the second node N2 in the (n+1)th frame, because in the initialization phase, the electric potential −3V of the first node N1 in the nth frame is switched from 3.44V (the electric potential of the first node N1 in the light emitting phase of the (n−1)th frame), while the electric potential −3V of the first node N1 in the (n+1)th frame is switched from 1.5V. There exists a parasitic capacitance between the first node N1 and the second node N2 of the pixel circuit and the second node N2 is a floating state in the initialization phase, so voltage change amount ΔV of the first node N1 is not consistent in each frame, causing that the electric potential of the second node N2 in the initialization phase of the nth frame is different from that in the initialization phase of the (n+1)th frame and further causing that in the data writing phase, the electric potential of the first node N1 in the nth frame is different from that in the (n+1)th frame, thereby causing a problem that the brightness signal intensity of the nth frame is not consistent with that of the (n+1)th frame. For example, the (n−1)th frame corresponds to a black image displayed by the pixels, and the nth frame corresponds to a white image displayed by the pixels and may be the first frame, causing that the brightness signal intensity of the first frame is not consistent with a target brightness signal intensity. Moreover, after the pixel circuit drives the light-emitting element for emitting light for a period of time, the threshold voltage of the driving transistor is shifted due to a bias stress, and a hysteresis effect occurs due to different shifts, thereby leading to an afterimage phenomenon and affecting the display effect.

The method for driving a pixel circuit according to embodiments of the present disclosure is applied to the pixel circuit shown in FIG. 2. In the time for displaying one frame of image, there are N initialization phases and N data signal voltage writing phases before a light-emitting phase. In the initialization phase, the initialization voltage applied to the gate electrode of the driving transistor T1 by the initialization module 16. In the data signal voltage writing phase, the data signal voltage is applied to the gate electrode of the driving transistor T1 by the data signal voltage writing module 13. Specifically, the data signal voltage is applied to the first (source) electrode of the driving transistor T1 by the data signal voltage writing module 13, and then is applied to the gate electrode of the driving transistor T1 via the driving transistor T1 and a threshold compensation module 14. In this way, by performing N initialization phases and N data signal voltage writing phases with each initialization phase before a corresponding data signal voltage writing phase. That is, by performing a plurality of initializations on the first node N1 and enforcing the voltage of the second node N2 to be the data signal voltage before the last data signal voltage writing phase of each frame, after N initialization phases and (N−1) data signal voltage writing phases, the electric potential of the first node N1 is consistent in each frame and the electric potential of the second node N2 is also consistent in each frame, thereby solving the problem that the brightness at the beginning of switching between black image and white image in the display process is less than a target brightness, alleviating the brightness inconsistence phenomenon and improving display uniformity. Every time the initialization voltage is applied to the gate electrode of the driving transistor T1 and the data signal voltage is applied to the source electrode of the driving transistor T1, a large current flows through the driving transistor, so N large currents flow through the driving transistor after the initialization voltage is applied to the driving transistor for N times and the data signal voltage is applied to the driving transistor for N times. In this way, the performance drift of the driving transistor T1 due to the bias is restored, the hysteresis effect of the driving transistor T1 is alleviated, and the display effect is improved.

Figure 3:
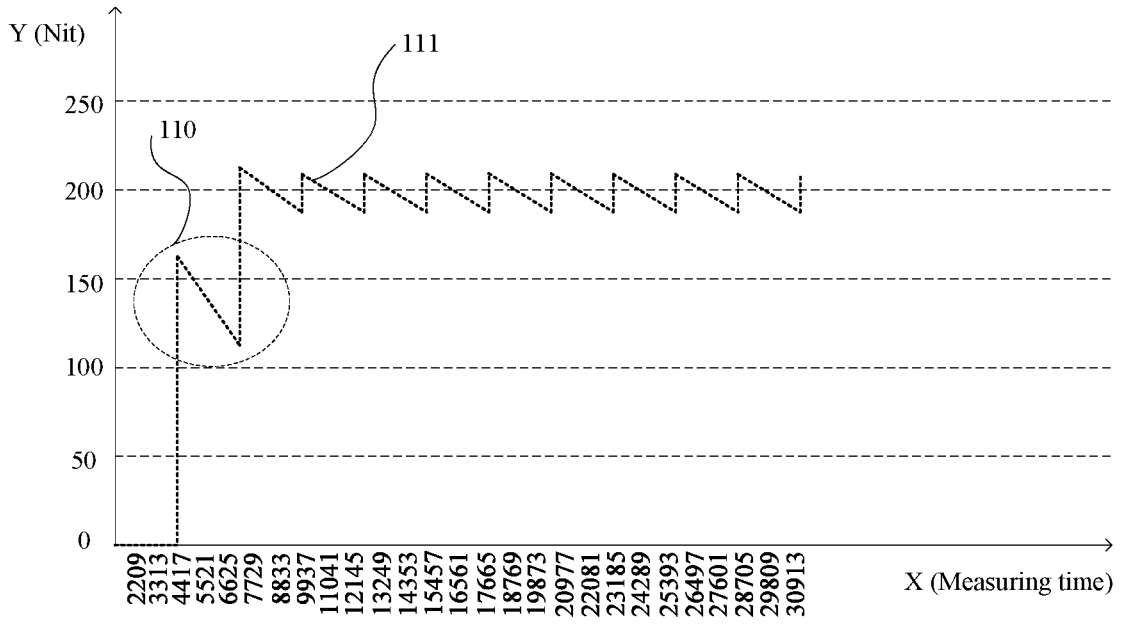
FIG. 3 is a chart showing a brightness signal intensity change when switching from a black image to a white image according to a method for driving a pixel circuit according to the related art.
Figure 4:
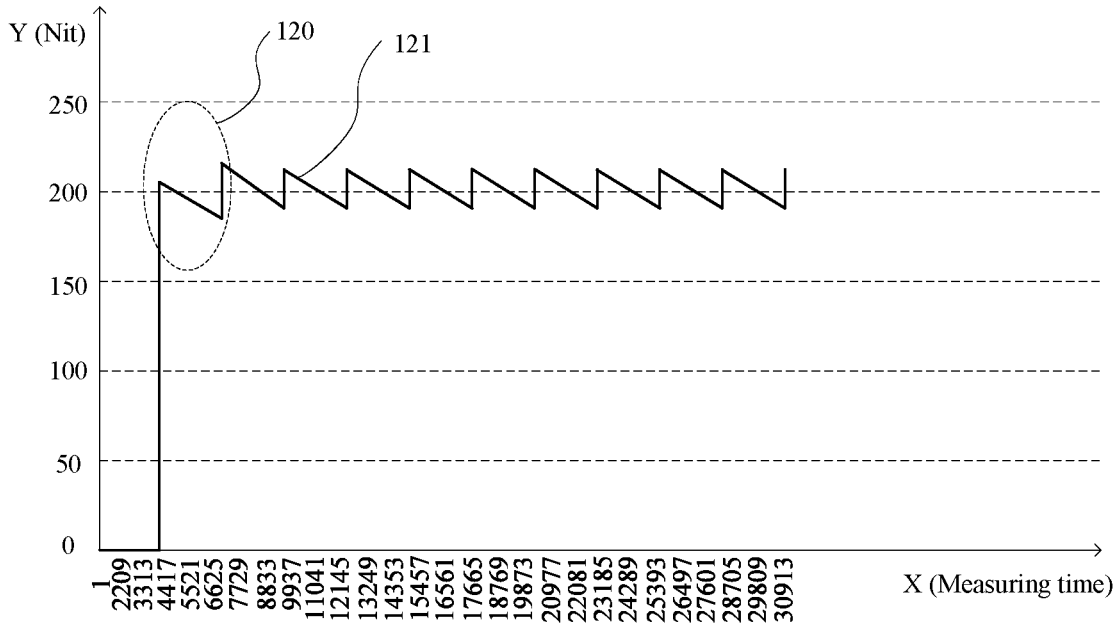
FIG. 4 is a schematic diagram showing a brightness signal intensity change when switching from a black image to a white image according to a method for driving a pixel circuit according to an embodiment of the present disclosure.

FIG. 3 is a schematic diagram showing a brightness signal intensity change when switching from a black image to a white image according to a method for driving a pixel circuit according to related art. FIG. 4 is a schematic diagram showing a brightness signal intensity change when switching from a black image to a white image according to a method for driving a pixel circuit according to an embodiment of the present disclosure. As shown in FIG. 3 and FIG. 4, the horizontal axis X represents and indicates measurement time points, and the longitudinal axis Y represents the brightness signal intensity. A brightness signal intensity variation curve 111 in FIG. 3 is compared with a brightness signal intensity variation curve 121 in FIG. 4. The "110" denotes the brightness signal intensity of the first frame of white image in FIG. 3, and the "120" denotes the brightness signal intensity of the first frame of white image in FIG. 4. For a white image with a target grayscale, when the existing method for driving the pixel circuit is used to switch from the black image to the white image of the target grayscale, the brightness signal intensity Y of the first frame of white image is just about 160 lower than the normal target brightness signal intensity 210. However, in the case where the method for driving the pixel circuit provided by embodiments of the present disclosure is used, when switching from the black image to the white image, the brightness signal intensity of the first frame of white image approximates within the range of 200 to 210 and is nearly the same as the normal target brightness signal intensity 210. As a result, the method for driving the pixel circuit provided by embodiments of the present disclosure effectively solves the problem that when switching from black image to white image, the brightness signal intensity of the first frame of white image is low, and alleviates the hysteresis effect of the driving transistor and improves the display effect.

The pixel circuit provided by embodiments of the present disclosure further includes a first light-emitting control module configured to control the light-emitting element to emit light. In the N initialization phases and N data signal voltage writing phases, the first light-emitting control module is turned off. If the first light-emitting control module is turned on in the initialization phase and the data signal voltage writing phase, the data signal voltage cannot be effectively applied to the gate electrode of the driving transistor. For example, as shown in FIG. 2, if the first light-emitting control module 14 is turned on in the initialization phase and the data signal voltage writing phase, the data line Vdata and the first power voltage signal line PVDD may be short-circuited. The second light-emitting control module 15 shown in FIG. 2 may serve as the first light-emitting control module 14. If the second light-emitting control module 15 is turned on in the N initialization phases and N data signal voltage writing phases, the driving current generated by the driving transistor T1 flows through the light-emitting element and drives the light-emitting element 11 to emit light. Meanwhile, the electric potential of the gate electrode of the driving transistor is changing, the generated driving current is changed accordingly, and a flicker may be caused. Therefore, it is necessary to control the first light-emitting control module 14 to be turned off in the N initialization phases and N data signal voltage writing phases.

Figure 5:
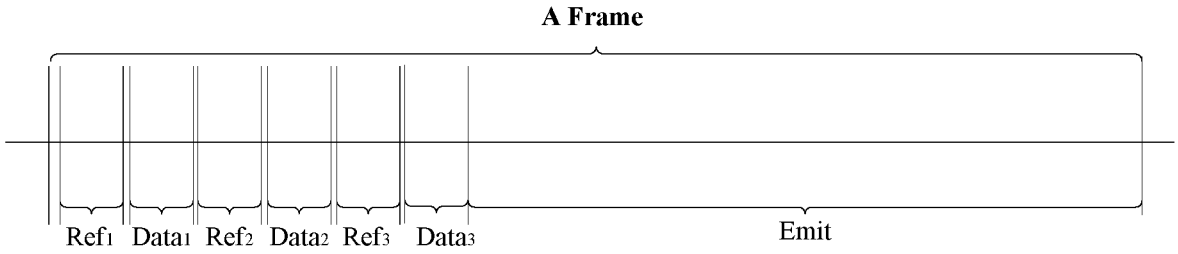
FIG. 5 is a schematic diagram of another driving time cycle according to an embodiment of the present disclosure.

FIG. 5 is a schematic diagram of another driving period according to an embodiment of the present disclosure. As shown in FIG. 5, the number N in the method for driving the pixel circuit provided by embodiments of the present disclosure is equal to 3. That is, in the time for displaying a frame, there are 3 initialization phases and 3 data signal voltage writing phases before the light-emitting phase. These phases are sequentially arranged as follows: a first initialization phase $Ref_1$, a first data signal voltage writing phase $Data_1$, a second initialization phase $Ref_2$, a second data signal voltage writing phase $Data_2$, a third initialization phase $Ref_3$, a third data signal voltage writing phase $Data_3$, and the light-emitting phase Emit.

In this way, in the time for displaying a frame according to the method for driving the pixel circuit provided by embodiments of the present disclosure, by the 3 initialization phases and 3 data signal voltage writing phases before the light-emitting phase, the large current flows through the driving transistor for 3 times, thereby alleviating the hysteresis effect caused by the threshold voltage drift of the driving transistor, solving the problem that the brightness of the beginning time of switching from a black image to a white image in the display process cannot reach the target brightness, and improving the display effect. If the number of initialization phases and data signal voltage writing phases is small, the hysteresis effect of the driving transistor cannot be effectively alleviated. In addition, since each initialization phase and each data signal voltage writing phase require a certain time, arranging too many initialization phases and data signal voltage writing phases may cause the reduction of the duration of the light-emitting phase, thereby causing flickers of the display image and affecting the display effect. Therefore, arranging 3 initialization phases and 3 data signal voltage writing phases before the light-emitting phase in the time for displaying a frame, not only can effectively alleviate the hysteresis effect caused by the threshold voltage drift of the driving transistor, but also avoid the problem of display image flickers caused by a too long time interval of the light-emitting phases, thereby further improving the display effect.

Further, in the method for driving the pixel circuit provided by embodiments of the present disclosure, in each of first data signal voltage writing phase to the (N−1)th data signal voltage writing phase, the data signal voltage writing module applies a voltage for grayscale of 0 or a voltage for grayscale of 255; in the Nth data signal voltage writing phase, the data signal voltage applied by the data signal voltage writing module may correspond to any of grayscales 0 to 255.

For some types of display panels, the voltage for grayscale of 0 corresponds to the black image, and the voltage for grayscale of 255 corresponds to the white image. For other types of display panels, the voltage for grayscale of 0 corresponds to the white image, and the voltage for grayscale of 255 corresponds to the black image. In embodiments of the present disclosure, the voltage for grayscale of 0 or the voltage for grayscale of 255 corresponds to the white images displayed by different products. That is, in each of the first data signal voltage writing phase to the (N−1)th data signal voltage writing phase, the data signal voltage writing module applies a data signal voltage corresponding to the maximum brightness signal intensity to the gate electrode of the driving transistor. In this case, the current flowing through the driving transistor is the maximum, the threshold voltage drift of the driving transistor is alleviated to the maximum extent, and the hysteresis effect of the driving transistor is improved to the maximum extent. In the Nth data signal voltage writing phase, it is necessary to apply the target grayscale voltage corresponding to the current frame. Therefore, in the Nth data signal voltage writing phase, the data signal voltage writing module applies the data signal voltage which corresponds to any of grayscales of 0 to 255.

Further, in the method for driving the pixel circuit provided by embodiments of the present disclosure, any adjacent two initialization phases have the same time interval, and any adjacent two data signal voltage writing phases have the same time interval. In this way, the programming design of the initialization phases and the data signal voltage writing phases is simplified. The initialization phases and the data signal voltage writing phases are generally within the time periods when the scanning line outputs the scanning signal, so the scanning signal may be used as the control signal for controlling the time interval between two adjacent initialization phases and the time interval between two adjacent data signal voltage writing phases. Therefore, two adjacent rows of pixel circuits may share one scanning line. On the one hand, the material cost of the first scanning line and the second scanning line is reduced; on the other hand, the area on the array substrate occupied by the first scanning line and the second scanning line is reduced. Moreover, the number of driving circuits for providing scanning signals to the scanning lines is reduced. Since the driving circuits are typically arranged at a bezel area of the display panel, such arrangement facilitates the narrow bezel design of the array substrate.

Figure 6:
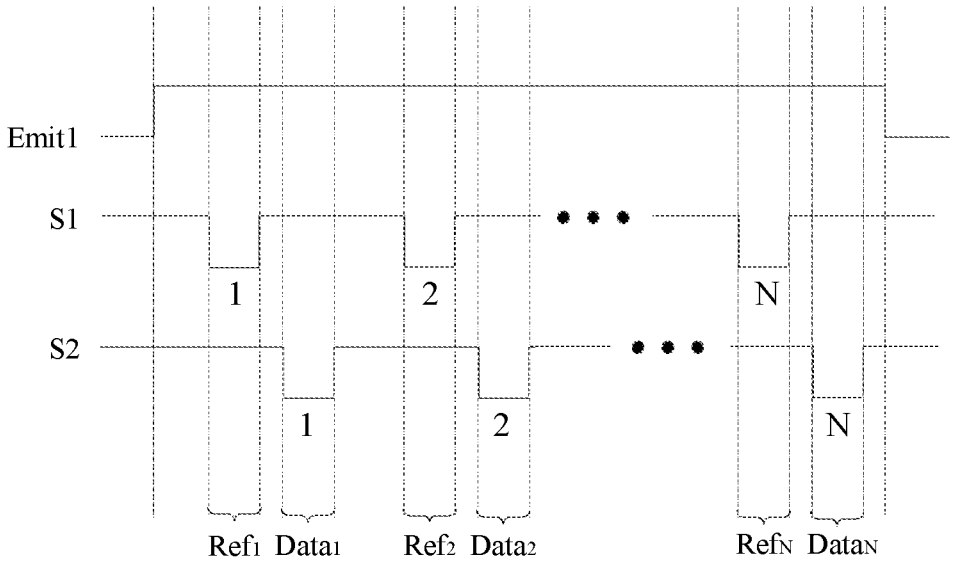
FIG. 6 is a driving timing diagram according to an embodiment of the present disclosure.

FIG. 6 is a driving timing diagram according to an embodiment of the present disclosure. With reference to FIG. 6 and FIG. 2, according to the method for driving the pixel circuit provided by embodiments of the present disclosure, a control terminal of the initialization module 16 is electrically connected to the first scanning line S1, a control terminal of the data signal voltage writing module 13 is electrically connected to the second scanning line S2, and a control terminal of the first light-emitting control module 14 is electrically to a first light-emitting signal line Emit1. Each of the first scanning line S1 and the second scanning line S2 has N scanning signal pules, and the first light-emitting signal line Emit1 has at least one scanning signal pule. The at least one scanning signal pule of the first light-emitting signal line Emit1 covers the N scanning signal pules of the first scanning line S1 and the N scanning signal pules of the second scanning line S2.

At this moment, the first scanning line S1 controls the initialization module 16 to apply the initialization voltage to the driving transistor T1, and the second scanning line S2 controls the data signal voltage writing module 13 to apply the data signal voltage to the driving transistor T1. Each of the first scanning line S1 and the second scanning line S2 has N scanning signal pules, that is, the initialization module 16 applies the initialization voltage to the driving transistor T1 for N times, and the data signal voltage writing module 13 applies the data signal voltage to the driving transistor T1 for N times. In this way, by repeating initialization and then applying the data signal voltage for N times, the initialization voltage for driving the gate electrode of the driving transistor and the data signal voltage for driving the source electrode of the driving transistor make a large current to flow through the driving transistor for N times, thereby alleviating the hysteresis effect caused by the threshold voltage drift of the driving transistor, solving the problem that the brightness cannot reach the target brightness when switching from a black image to a white image in the display process, and improving the display effect.

In addition, the first light-emitting signal line Emit1 controls the first light-emitting control module 14 to be turned on and to be turned off. Exemplarily, as shown in FIG. 6, one pulse of the first light-emitting signal line Emit1 covers the N scanning signal pules of the first scanning line S1 and the N scanning signal pules of the second scanning line S2. In this way, an initialization phase and then a data signal voltage writing phase are performed for N times at the driving transistor T1, and the first light-emitting control module 14 is turned off. If the first light-emitting control module 14 is turned on in the initialization phases and the data signal voltage writing phases, the electric potential of the gate electrode of the driving transistor is varying, and a flicker may be caused. Therefore, in the initialization phases and the data signal voltage writing phases, the first light-emitting control module is turned off, thereby effectively preventing the flicker and further improving the display effect.

Furthermore, in the method for driving the pixel circuit provided by embodiments of the present disclosure, the light-emitting phase Emit includes at least one light-emitting sub-phase and at least one turn-off phase. The first light-emitting control module is turned on in the light-emitting sub-phase, and the first light-emitting control module is turned off in the turn-off phase. The light-emitting phase Emit includes at least one light-emitting sub-phase and at least one turn-off phase. The brightness of the display panel may be easy to be adjusted by arranging the number of the light-emitting sub-phases and the turn-off phases and providing corresponding driving signals.

In the following, three different pixel circuits are used as examples to describe the implementation process of the pixel circuit driving method according to embodiments of the present disclosure.

Figure 7:
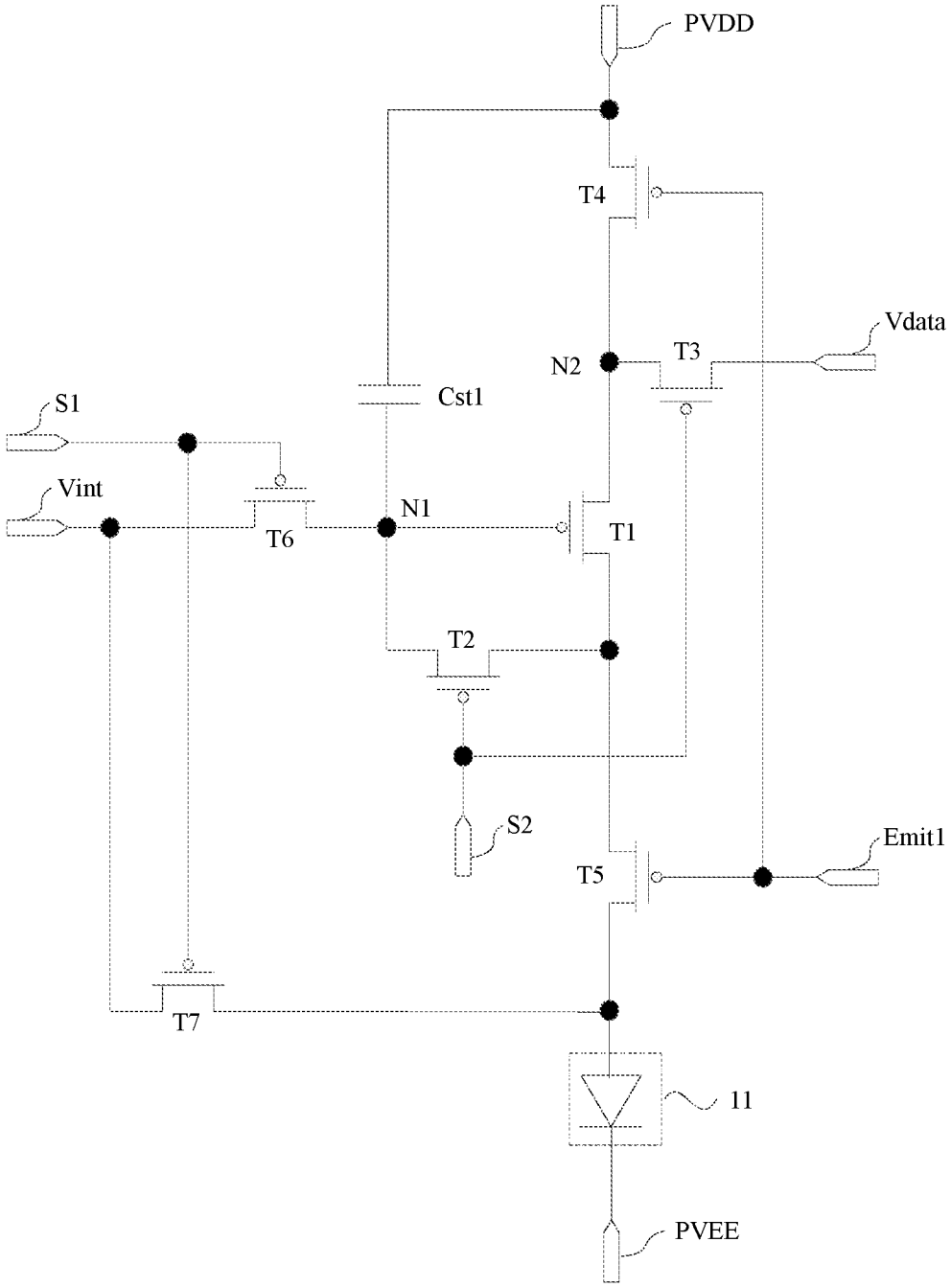
FIG. 7 is a circuit diagram of a pixel circuit according to an embodiment of the present disclosure.

FIG. 7 is a circuit diagram of a pixel circuit according to an embodiment of the present disclosure. With reference to FIG. 7, the pixel circuit further includes a threshold compensation module. The threshold compensation module includes a second transistor T2. The data signal voltage writing module includes a third transistor T3. The first light-emitting control module includes a fourth transistor T4 and a fifth transistor T5. The initialization module includes a sixth transistor T6. The storage module includes a first capacitor Cst1.

A first electrode of the second transistor T2 is electrically connected to a second electrode of the driving transistor T1, a second electrode of the second transistor T2 is electrically connected to the gate electrode of the driving transistor T1, and a gate electrode of the second transistor T2 is electrically connected to the second scanning line S2.

A first electrode of the third transistor T3 is electrically connected to a data line Vdata, a second electrode of the third transistor T3 is electrically connected to the first electrode of the driving transistor T1, and a gate electrode of the third transistor T3 is electrically connected to the second scanning line S2.

A first electrode of the fourth transistor T4 is electrically connected to a first power voltage signal line PVDD, a second electrode of the fourth transistor T4 is electrically connected to the first electrode of the driving transistor T1, and a gate electrode of the fourth transistor T4 is electrically connected to a first light-emitting signal line Emit1.

A first electrode of the fifth transistor T5 is electrically connected to the second electrode of the driving transistor T1, a second electrode of the fifth transistor T5 is electrically connected to a first electrode of the light-emitting element 11, and a gate electrode of the fifth transistor T5 is electrically connected to the first light-emitting signal line Emit1.

A first electrode of the sixth transistor T6 is electrically connected to an initialization voltage signal line Vint, a second electrode of the sixth transistor T6 is electrically connected to the gate electrode of the driving transistor T1, and a gate electrode of the sixth transistor T6 is electrically connected to the first scanning line S1.

A first electrode of the first capacitor Cst1 is electrically connected to the gate electrode of the driving transistor T1, and a second electrode of the first capacitor Cst1 is electrically connected to the first power voltage signal line PVDD.

A second electrode of the light-emitting element 11 is electrically connected to a second power voltage signal line PVEE.

Figure 8:
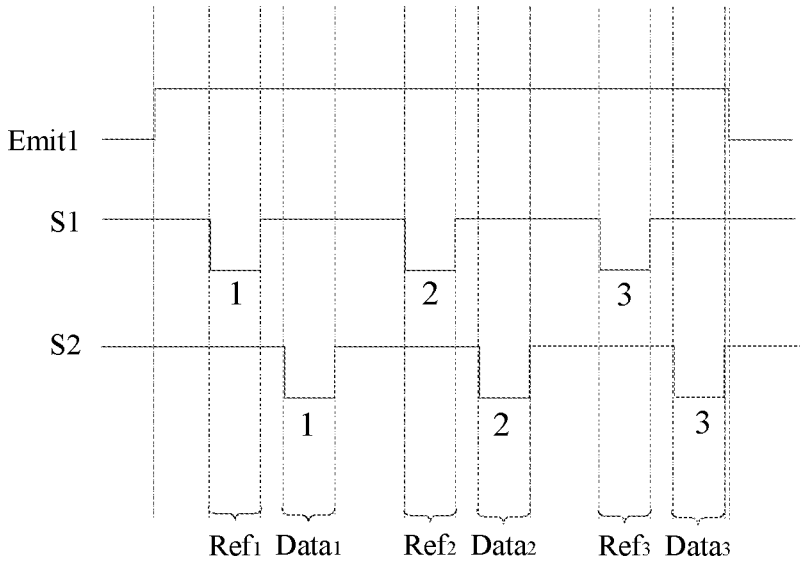
FIG. 8 is another driving timing diagram according to an embodiment of the present disclosure.

Exemplarily, FIG. 8 is another driving timing diagram according to an embodiment of the present disclosure. The value N is arranged to be 3 as an example, which is not intended to limit the method for driving the pixel circuit provided by embodiments of the present disclosure. With reference to FIG. 7 and FIG. 8, taking an configuration in which the driving transistor T1, the second transistor T2, the third transistor T3, the fourth transistor T4, the fifth transistor T5 and the sixth transistor T6 are P-type transistors as an example, the specific operation process of the method for driving the pixel circuit provided by embodiments of the present disclosure is exemplarily described.

In the $Ref_1$ phase, namely the first initialization phase, the signal of the first scanning line S1 is at a low level. As a result, the sixth transistor T6 is turned on, the initialization voltage of the initialization voltage signal line Vint is applied to the gate electrode of the driving transistor T1 through the sixth transistor T6, the initialization voltage may be at low level and initialize the voltage of the gate electrode of the driving transistor T1 and the voltage of the first electrode of the first capacitor Cst1, ensuring that the driving transistor T1 is turned on in the next phase and the data signal voltage can be applied to the gate electrode of the driving transistor.

In the $Data_1$ phase, namely the first data signal voltage writing phase, the signal of the second scanning line S2 is at a low level. As a result, the second transistor T2 and the third transistor T3 are turned on, and the data signal voltage of the data line Vdata is applied to the gate electrode of the driving transistor T1 and first electrode of the first capacitor Cst1 via the third transistor T3, the driving transistor T1 and the second transistor T2 sequentially. The voltage of the gate electrode of the driving transistor T1 gradually increases. When the difference between the voltage of the gate electrode and the voltage of the source electrode of the driving transistor T1 is less than or equal to the threshold voltage of the driving transistor T1, the driving transistor T1 is turned off and the voltage of the gate electrode of the driving transistor T1 will not be changed. At this moment, the voltage of the gate electrode of the driving transistor T1, namely the voltage of the first node N1 is $V_1=V_{data}-|V_{th}|$, where $V_{data}$ denotes the value of the data signal voltage of the data line Vdata and $V_{th}$ denotes the threshold voltage of the driving transistor T1.

The state variation and voltage writing status of each transistor in the $Ref_2$ phase and the $Data_2$ phase are similar to those in the $Ref_1$ phase and the $Data_1$ phase. The state variation and voltage writing status of each transistor in the $Ref_3$ phase and the $Data_3$ phase are similar to those in the $Ref_1$ phase and the $Data_1$ phase. It should be noted that the data signal voltage of the data signal line in the $Data_1$ phase and the data signal voltage of the data signal line in the $Data_2$ phase may be the same as, or different from the data signal voltage of the data signal line in the $Data_3$ phase, as long as the data signal voltage of the data signal line in the $Data_1$ phase and $Data_2$ phase can make the driving transistor to be turned on and have a current flowing there through. The data signal voltage of the data signal line in the $Data_3$ phase is the grayscale voltage to be applied in this frame. The voltage of the second node N2 is enforced to be the data signal voltage in the $Data_1$ phase and the $Data_2$ phase, and the voltage of the first node N1 is enforced to be the initialization voltage in the Ref1 phase, the $Ref_2$ phase and the $Ref_3$ phase, such that, after N initialization phases and (N−1) data signal voltage writing phases, the electric potential of the first node N1 is consistent in each frame and the electric potential of the second node N2 is also consistent in each frame, thereby solving the problem that the brightness at the beginning time cannot reach the target brightness when switching from a black image to a white image in the display process, alleviating a brightness inconsistent phenomenon and improving display uniformity. Moreover, the large current flows through the driving transistor T1 for 3 times due to the initialization voltage of the gate electrode of the driving transistor T1 and the voltage of the source electrode of the driving transistor T1 in each data signal voltage writing phase. As a result, the threshold voltage $V_{th}$ drift of the driving transistor T1 is alleviated, the hysteresis effect of the driving transistor T1 is alleviated, and the display effect is improved.

In the phase after the $Data_3$ phase, which is also referred to as the light-emitting phase, the signal of the first light-emitting signal line Emit1 is at a low level, the fourth transistor T4 and the fifth transistor T5 are turned on; both of the signal of the first scanning line S1 and the signal of the second scanning line S2 are at a high level, the sixth transistor T6, the second transistor T2 and the third transistor T3 are turned off. The voltage of the first electrode (source electrode) of the driving transistor T1 is $V_{PVDD}$, a difference between the voltages of the source electrode and the gate electrode of the driving transistor is $V_{sg}=V_{PVDD}-V_1=V_{PVDD}-V_{data}-|V_{th}|$, the drain current of the driving transistor T1 (that is, the driving current generated by the driving transistor T1) drives the light-emitting element 11 to emit light, and the driving current $I_d$ satisfies the following formula:

$$I_d = \frac{1}{2}\mu C_{ox}\frac{W}{L}(V_{sg}-|V_{th}|)^2 = \frac{1}{2}\mu C_{ox}\frac{W}{L}(V_{PVDD}-V_{data}+|V_{th}|-|V_{th}|)^2 = \frac{1}{2}\mu C_{ox}\frac{W}{L}(V_{PVDD}-V_{data})^2 \quad (1)$$

In the above formula, μ denotes the mobility of the carrier of the driving transistor T1, W denotes the width of the channel of the driving transistor T1, L denotes the length of the channel of the driving transistor T1, $C_{ox}$ denotes the gate oxide layer capacitance per unit area of the driving transistor T1, and $V_{PVDD}$ denotes the voltage value of the first power voltage signal line PVDD, that is, the voltage value of the second node N2. As shown by the formula, the driving current $I_d$ generated by the driving transistor T1 is independent of the threshold voltage $V_{th}$ of the driving transistor T1, thereby solving the display abnormality caused by the drifting of the threshold voltage of the driving transistor T1.

In addition, one pulse of the first light-emitting signal line Emit1 covers the 3 scanning pulse signals of the first scanning line S1 and the 3 scanning pulse signals of the second scanning line S2. In this way, during the 3 initialization phases and the 3 data signal voltage writing phases at the driving transistor T1, the fourth transistor T4 and the fifth transistor T5 are turned off. If the fourth transistor T4 and the fifth transistor T5 are turned on during the initialization phases and the data signal voltage writing phases, the data signal voltage cannot be effectively applied to the gate electrode of the driving transistor T1, as a result, the voltage of the gate electrode of the driving transistor T1 is varying, and the flicker may be caused. Therefore, the fourth transistor T4 and the fifth transistor T5 are turned off during the initialization phases and the data signal voltage writing phases, that is, the first light-emitting control module 14 is turned off, which can effectively prevent the flicker and further improve the display effect.

Figure 9:
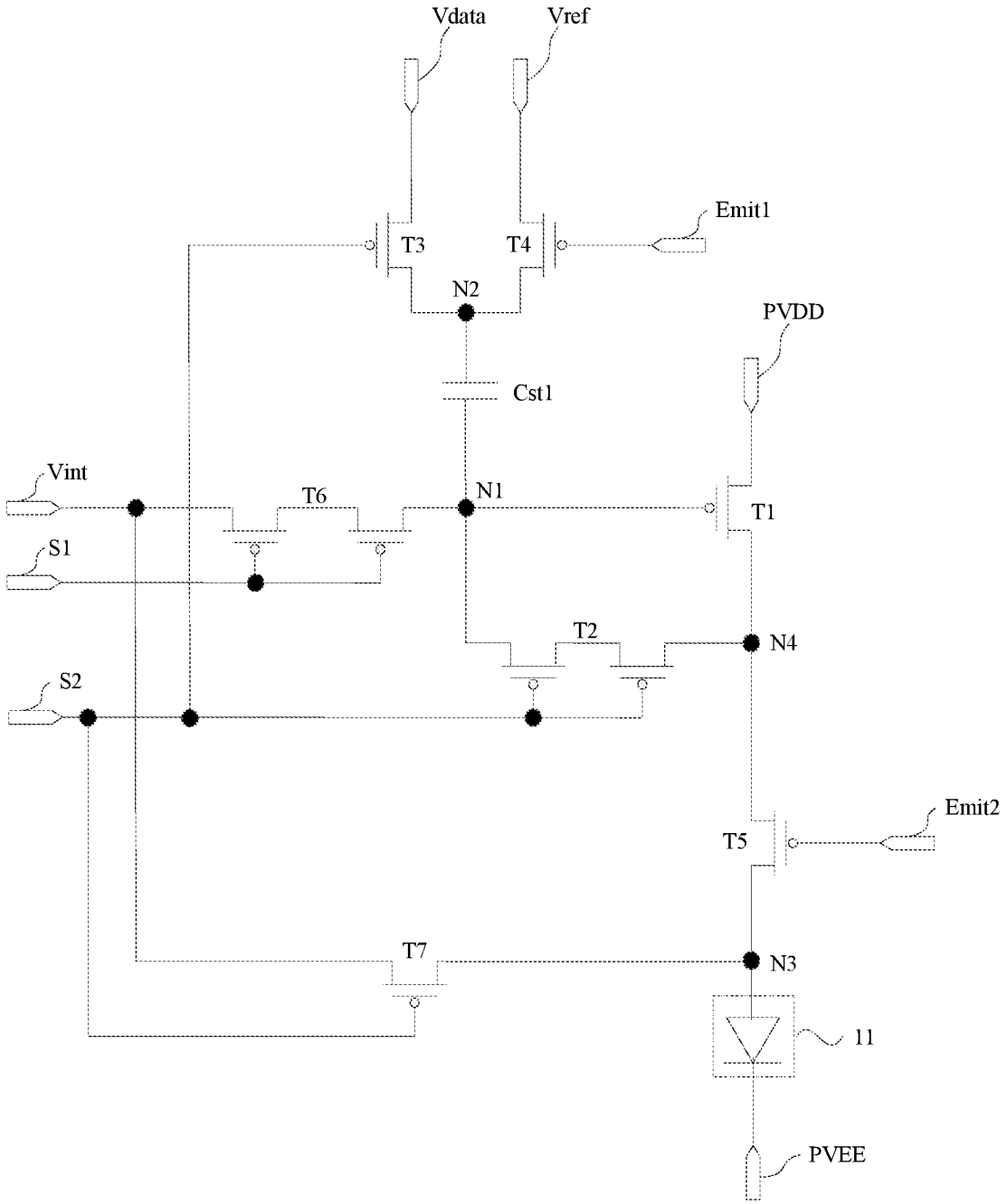
FIG. 9 is a circuit diagram of another pixel circuit according to an embodiment of the present disclosure.

FIG. 9 is a circuit diagram of another pixel circuit according to an embodiment of the present disclosure. With reference to FIG. 9, the pixel circuit further includes a threshold compensation module and a second light-emitting control module. The threshold compensation module includes a second transistor T2. The data signal voltage writing module includes a third transistor T3. The first light-emitting control module includes a fourth transistor T4. The second light-emitting control module includes a fifth transistor T5. The initialization module includes a sixth transistor T6. The storage module includes a first capacitor Cst1.

A first electrode of the driving transistor T1 is electrically connected to the first power voltage signal line PVDD, and a first electrode of the first capacitor Cst1 is electrically connected to the gate electrode of the driving transistor T1, that is, the first node N1.

A first electrode of the second transistor T2 is electrically connected to the second electrode of the driving transistor T1, a second electrode of the second transistor T2 is electrically connected to the gate electrode of the driving transistor T1, and a gate electrode of the second transistor T2 is electrically connected to the second scanning line S2.

A first electrode of the third transistor T3 is electrically connected to the data line Vdata, a second electrode of the third transistor T3 is electrically connected to the second electrode of the first capacitor Cst1, and a gate electrode of the third transistor T3 is electrically connected to the second scanning line S2.

A first electrode of the fourth transistor T4 is electrically connected to one of the first power voltage signal line PVDD and a first reference voltage signal line Vref, a second electrode of the fourth transistor T4 is electrically connected to the second electrode of the first capacitor Cst1, and a gate electrode of the fourth transistor T4 is electrically connected to the first light-emitting signal line Emit1.

A first electrode of the fifth transistor T5 is electrically connected to the second electrode of the driving transistor T1, a second electrode of the fifth transistor T5 is electrically connected to the first electrode of the light-emitting element 11, and a gate electrode of the fifth transistor T5 is electrically connected to the second light-emitting line Emit2.

A second electrode of the light-emitting element 11 is electrically connected to the second power voltage signal line PVEE.

A first electrode of the sixth transistor T6 is electrically connected to the initialization voltage signal line Vint, a second electrode of the sixth transistor T6 is electrically connected to the gate electrode of the driving transistor T1, and a gate electrode of the sixth transistor T6 is electrically connected to the first scanning line S1.

Figure 10:
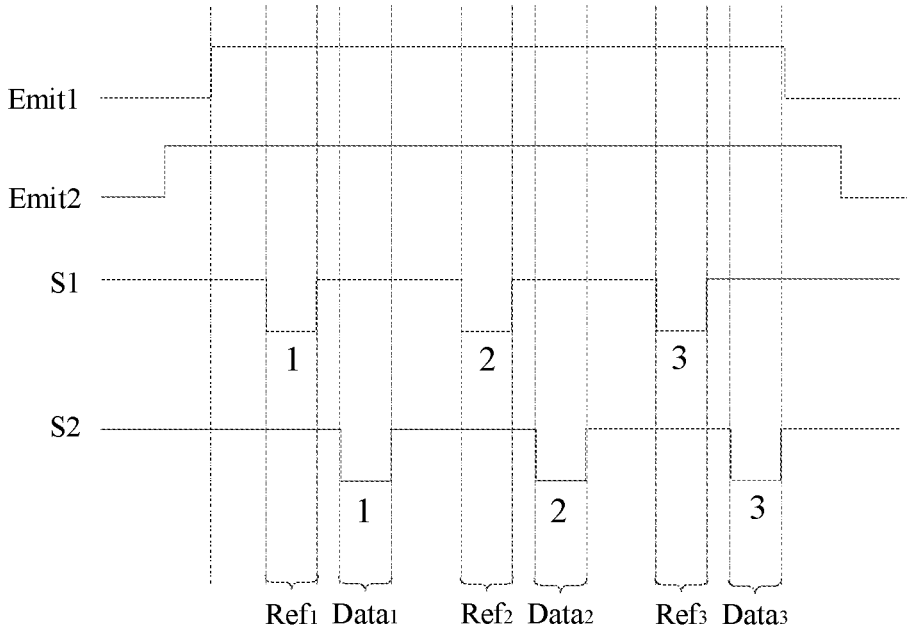
FIG. 10 is another driving timing diagram according to an embodiment of the present disclosure.

Exemplarily, FIG. 10 is another driving timing diagram according to an embodiment of the present disclosure, the value N is arranged to be 3 as an example, but is not intended to limit the method for driving the pixel circuit provided by embodiments of the present disclosure. With reference to FIG. 9 and FIG. 10, taking an configuration in which the driving transistor T1, the second transistor T2, the third transistor T3, the fourth transistor T4, the fifth transistor T5 and the sixth transistor T6 are P-type transistors as an example, the specific operation process of the method for driving the pixel circuit provided by embodiments of the present disclosure is exemplarily described.

With reference to FIG. 9 and FIG. 10, in the $Ref_1$ phase, namely the first initialization phase, the signal of the first scanning line S1 is at a low level, so the sixth transistor T6 is turned on. The signal of the second scanning line S2 is at a high level, so the second transistor T2 and the third transistor T3 are turned off. The signal of the first light-emitting signal line Emit1 is at a high level, so the fourth transistor T4 is turned off. The signal of the second light-emitting signal line Emit2 is at a high level, so the fifth transistor T5 is turned off. The initialization voltage of the initialization voltage signal line Vint is applied to the gate electrode (namely the first node N1) of the driving transistor T1 through the sixth transistor T6, the initialization voltage may be at the low level, such that both of the electric potential of the first node N1 and the electric potential of the first electrode of the light-emitting element 11 are at low level after the initialization phase. Moreover, in the initialization phase, the fifth transistor T5 is turned off, the driving transistor T1 is disconnected from the light-emitting element, such that almost no current flows through a light-emitting diode in the initialization phase, the brightness of the dark state is reduced, and the contrast of the product is improved.

In the $Data_1$ phase, namely the data signal voltage writing phase, the signal of the first scanning line S1 is at a high level, so the sixth transistor T6 is turned off. The signal of the second scanning line S2 is at a low level, so the second transistor T2, the third transistor T3 and the driving transistor T1 are turned on. The gate electrode of the driving transistor T1 is at the low level in the $Ref_1$ phase, so the driving transistor T1 is turned on, a current conduction path is formed between the driving transistor T1 and the second transistor T2, the voltage of the first power voltage signal line PVDD is applied to the first node N1 through the current conduction path, and the electric potential of the first node N1 is pulled up by the voltage of the first power voltage signal line PVDD. When the voltage of the gate electrode of the driving transistor T1 is pulled up to an extent that the difference between the voltage of the gate electrode and the voltage of the source electrode is less than or equal to the threshold voltage $V_{th}$ of the driving transistor T1, the driving transistor T1 is turned off. Since the source electrode of the driving transistor T1 is connected to the first power voltage signal line and the electric potential of the source electrode is maintained at $V_{PVDD}$ without changing, so when the driving transistor T1 is turned off, the electric potential of the driving transistor T1 is $V_{PVDD}-|V_{th}|$, where $V_{PVDD}$ denotes the value of the voltage of the first power voltage signal line PVDD, and I Vail denotes the threshold voltage of the driving transistor.

At the moment, a difference between the voltage of the first electrode and the voltage of the second electrode of the first capacitor Cst1 is:

$$V_c=V_1-V_2=V_{PVDD}-|V_{th}|V_{data} \tag{2}$$

In the above formula, $V_1$ denotes the electric potential of the first node N1, $V_2$ denotes the electric potential of the second node N2, and $V_{data}$ denotes the value of the data signal voltage of the data line Vdata.

In the data signal voltage writing phase, the difference $V_c$ between the voltage of the first electrode and the voltage of the second electrode of the first capacitor Cst1 contains the threshold voltage $V_{th}$ of the driving transistor T1. That is, in the data signal voltage writing phase, the threshold voltage $V_{th}$ of the driving transistor T1 is detected and stored in the first capacitor Cst1.

The state variation and voltage writing status of each transistor in the $Ref_2$ phase and the $Data_2$ phase, and the $Ref_3$ phase and the $Data_3$ phase are similar to those in the $Ref_1$ phase and the $Data_1$ phase. It should be noted that the data signal voltage of the data signal line in the $Data_1$ phase and the data signal voltage of the data signal line in the $Data_2$ phase may be the same as, or different from the data signal voltage of the data signal line in the $Data_3$ phase, as long as the data signal voltage of the data signal line in the $Data_1$ phase and $Data_2$ phase can make the driving transistor to be turned on and have a current flowing there through. The data signal voltage of the data signal line in the $Data_3$ phase is the grayscale voltage to be applied in this frame. In each data signal voltage writing phase, the initialization voltage at the gate electrode of the driving transistor T1 and the voltage of the source electrode of the driving transistor T1 cause a large current to flow through the driving transistor T1 for three times, alleviating the threshold voltage $V_{th}$ drift of the driving transistor T1, alleviating the hysteresis effect of the driving transistor T1 and improving the display effect.

After the $Data_3$ phase and before the light-emitting phase, the signal of the first scanning line S1 is at the high level, so the sixth transistor T6 and the seventh transistor T7 are turned off. The signal of the second scanning line S2 is at the high level, the second transistor T2, the third transistor T3 and the driving transistor are turned off. The initialization voltage of the initialization voltage signal line Vint is applied to the second node N2 (that is, the second electrode of the first capacitor Cst1) through the fourth transistor T4. Meanwhile, the second transistor T2, the third transistor T3, the fourth transistor T4 and the driving transistor T1 are turned off, that is, the second electrode of the first capacitor Cst1 is equivalent to being disconnected, the difference $V_c$ between the voltage of the first electrode and the voltage of the second electrode of the first capacitor Cst1 remains unchanged. However, since the electric potential of the second node N2 is changed to $V_{Vref}$, the electric potential of the first node N1 is changed according to following formula accordingly.

$$V'_2=V_c+V'_1=V_{PVDD}-|V_{th}|-V_{data}+V_{Vref} \tag{3}$$

That is, the data signal voltage is coupled to the first electrode of the first capacitor Cst1 through the first capacitor Cst1.

In the light-emitting phase, the signal of the first scanning line S1 is at the high level, so the sixth transistor T6 and the seventh transistor T7 are turned off. The signal of the second scanning line S2 is at the high level, so the second transistor T2, the third transistor T3 and the driving transistor T1 are turned off. The signal of the first light-emitting signal line Emit1 is at the low level, so the fourth transistor T4 is turned on. The signal of the second light-emitting signal line Emit2 is at the low level, so the fifth transistor T5 is turned on. At this moment, the voltage $V_{sg}$ between the source electrode and the gate electrode of the driving transistor is as follow.

$$V_{sg}=V_{PVDD}V'_2=|V_{th}|+V_{data}-V_{Vref} \tag{4}$$

Since the driving transistor works at the saturation region, the driving current that flows through the channel of the driving transistor is determined by the difference between the voltage of the gate electrode and the voltage of the source electrode of the driving transistor. According to transistor's electrical characteristics in the saturation region, the driving current may be obtained by the following formula.

$$I=K(V_{sg}-|V_{th}|)^2=K(V_{data}-V_{Vref})^2 \tag{5}$$

I denotes the driving current generated by the driving transistor T1, K is a constant and $$K=\frac{1}{2}\mu C_{ox}\frac{W}{L},$$

μ denotes the mobility of the carriers of the driving transistor T1, W denotes the width of the channel of the driving transistor T1, L denotes the length of the channel of the driving transistor T1, and $C_{ox}$ denotes the capacitance value per unit area of the gate oxide layer of the driving transistor. $V_{Vref}$ denotes the value of the voltage of the initialization voltage signal line Vref. The generated driving current drives the light-emitting element to emit light.

It should be noted that the signal of the first light-emitting signal line Emit1 and the signal of the second light-emitting signal line Emit2 shown in FIG. 10 may be the same. In this way, the fourth transistor T4 and the fifth transistor T5 of the pixel circuit shown in FIG. 9 may share one light-emitting signal line, thereby saving the quantity of the light-emitting signal lines and the quantity of driving circuits for the light-emitting signal lines.

Figure 11:
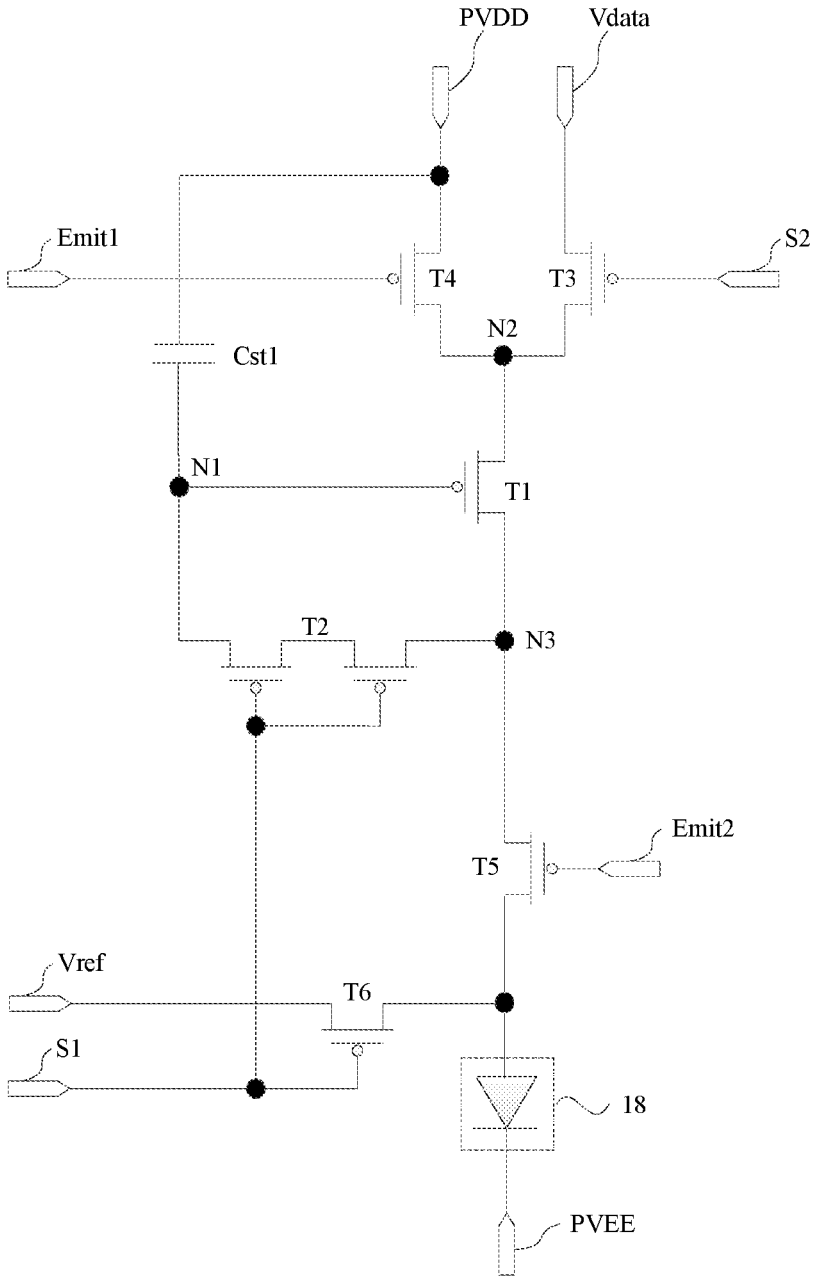
FIG. 11 is a circuit diagram of another pixel circuit according to an embodiment of the present disclosure.

FIG. 11 is a circuit diagram of another pixel circuit according to an embodiment of the present disclosure. As shown in FIG. 11, the pixel circuit further includes a threshold compensation module and a second light-emitting control module. The threshold compensation module includes at least one second transistor T2. The data signal voltage writing module includes a third transistor T3. The first light-emitting control module includes a fourth transistor T4. The second light-emitting control module includes a fifth transistor T5. The initialization module includes a sixth transistor T6. The storage module includes a first capacitor Cst1.

A first electrode of the second transistor T2 is electrically connected to the second electrode of the driving transistor T1, a second electrode of the second transistor T2 is electrically connected to the gate electrode of the driving transistor T1 (that is, the first node N1), and a gate electrode of the second transistor T2 is electrically connected to the first scanning line S1.

A first electrode of the third transistor T3 is electrically connected to a data line Vdata, a second electrode of the third transistor T3 is electrically connected to the first electrode of the driving transistor T1, and a gate electrode of the third transistor T3 is electrically connected to the second scanning line S2.

A first electrode of the fourth transistor T4 is electrically connected to the first power voltage signal line PVDD, a second electrode of the fourth transistor T4 is electrically connected to the first electrode of the driving transistor T1, and a gate electrode of the fourth transistor T4 is electrically connected to the first light-emitting control line Emit1.

A first electrode of the fifth transistor T5 is electrically connected to the second electrode of the driving transistor T1, a second electrode of the fifth transistor T5 is electrically connected to the first electrode of the light-emitting element 11, and a gate electrode of the fifth transistor T5 is electrically connected to the second light-emitting control line Emit2.

A first electrode of the sixth transistor T6 is electrically connected to a first reference voltage signal line Vref, a second electrode of the sixth transistor T6 is electrically connected to the first electrode of the light-emitting element 11, and a gate electrode of the sixth transistor T6 is electrically connected to the first scanning line S1.

A first electrode of the first capacitor Cst1 is electrically connected to the gate electrode of the driving transistor T1, and a second electrode of the first capacitor Cst1 is electrically connected to the first power voltage signal line PVDD.

A second electrode of the light-emitting element 11 is electrically connected to the second power voltage signal line PVEE.

Figure 12:
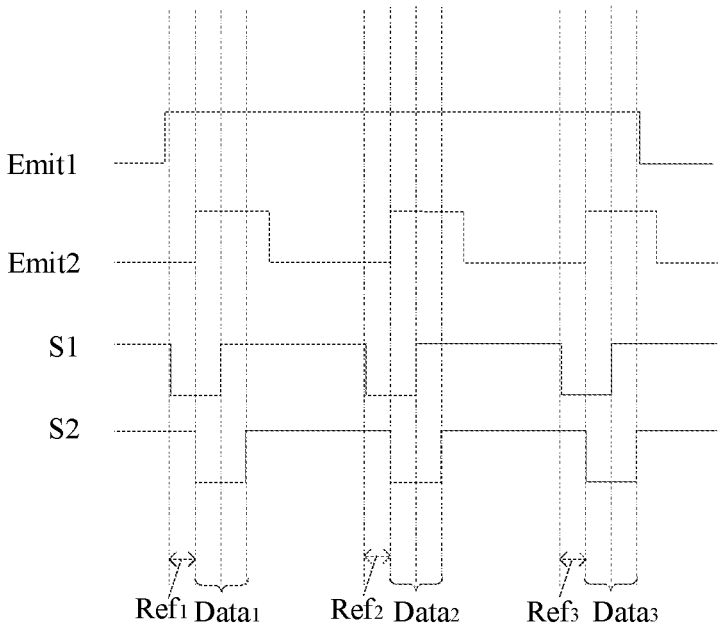
FIG. 12 is another driving timing diagram according to an embodiment of the present disclosure.

Exemplarily, FIG. 12 is another driving timing diagram according to an embodiment of the present disclosure. The value N is arranged to be 3 as an example, which is not intended to limit the method for driving the pixel circuit provided by embodiments of the present disclosure. With reference to FIG. 11 and FIG. 12, taking an configuration in which the driving transistor T1, the second transistor T2, the third transistor T3, the fourth transistor T4, the fifth transistor T5 and the sixth transistor T6 are P-type transistors as an example, the specific operation process of the method for driving the pixel circuit provided by embodiments of the present disclosure is exemplarily described.

In the $Ref_1$ phase, namely the first initialization phase, the signal of the first scanning line S1 is at the low level, so the second transistor T2 and the sixth transistor T6 are turned on. The signal of the second scanning line S2 is at the high level, so the third transistor T3 is turned off. The signal of the first light-emitting signal line Emit1 is at the high level, so the fourth transistor T4 is turned off. The signal of the second light-emitting signal line Emit2 is at the low level, so the fifth transistor T5 is turned on. The initialization voltage of the initialization voltage signal line Vint is applied to the gate electrode of the driving transistor T1 and the first electrode of the first capacitor Cst1 (namely the first node N1) through the sixth transistor T6, the fifth transistor T5 and the second transistor T2, to initialize the electric potential of the first node N1. In a previous phase within the $Data_1$ phase, the signal of the first scanning line S1 is at the low level, so the second transistor T2 and the sixth transistor T6 are turned on. The signal of the second scanning line S2 is at the low level, so the third transistor T3 is turned on. The signal of the first light-emitting signal line Emit1 is at the high level, so the fourth transistor T4 is turned off. The signal of the second light-emitting signal line Emit2 is at the high level, so the fifth transistor T5 is turned off. The data signal voltage of the data line Vdata is applied to the first electrode of the driving transistor T1 through the third transistor T3, to the gate electrode of the driving transistor T1 and the first electrode of the first capacitor Cst1 sequentially through the third transistor T3, the driving transistor T1 and the second transistor T2. So the electric potential of the gate electrode of the driving transistor T1 increases gradually, and when the difference between the voltage of the gate electrode and the voltage of the source electrode of the driving transistor T1 is less than or equal to the threshold voltage of the driving transistor T1, the driving transistor T1 is turned off and the voltage of the gate electrode of the driving transistor T1 remains unchanged. At this moment, the voltage of the gate electrode of the driving transistor T1, that is, the voltage of the first node N1 is $V_1=V_{data}-|V_{th}|$, where Vdata denotes the value of the data signal voltage of the data line Vdata, and $V_{th}$ denotes the threshold voltage of the driving transistor T1. In a later phase within the $Data_1$ phase, the driving transistor T1 is turned off, the fourth transistor T4 is also turned off, and the electric potential of the second node N2 remains unchanged.

The state variation and voltage writing status of each transistor in the $Ref_2$ phase and the $Data_2$ phase, and the $Ref_3$ phase and the $Data_3$ phase are similar to those in the $Ref_1$ phase and the $Data_1$ phase. It should be noted that the data signal voltage of the data signal line in the $Data_1$ phase and the data signal voltage of the data signal line in the $Data_2$ phase may be the same as, or different from the data signal voltage of the data signal line in the $Data_3$ phase, as long as the data signal voltages of the data signal line in the $Data_1$ phase and $Data_2$ phase can make the driving transistor to be turned on and have a current flowing there through. The data signal voltage of the data signal line in the $Data_3$ phase is the grayscale voltage to be applied in this frame. The voltage of the second node N2 is enforced to be the data signal voltages in the $Data_1$ phase and the $Data_2$ phase, and the voltage of the first node N1 is enforced to be the initialization voltages in the Ref1 phase, the $Ref_2$ phase and the $Ref_3$ phase, such that, after N initialization phases and (N−1) data signal voltage writing phases, the electric potential of the first node N1 is consistent in each frame and the electric potential of the second node N2 is also consistent in each frame, thereby solving the problem that the brightness at the beginning time of switching from a black image to a white image in the display process cannot reach the target brightness, alleviating the brightness inconsistent phenomenon and improving display uniformity. Moreover, the large current flows through the driving transistor T1 for 3 times due to the initialization voltage of the gate electrode of the driving transistor T1 and the voltage of the source electrode of the driving transistor T1 in each data signal voltage writing phase. As a result, the threshold voltage $V_{th}$ drift of the driving transistor T1 is alleviated, the hysteresis effect of the driving transistor T1 is alleviated, and the display effect is improved.

In the phase after the $Data_3$ phase, which is also referred to as the light-emitting phase, the signal of the first light-emitting signal line Emit1 is at the low level, the fourth transistor T4 is turned on; both of the signal of the first scanning line S1 and the signal of the second scanning line S2 are at the high level, the sixth transistor T6, the second transistor T2 and the third transistor T3 are turned off. The voltage of the first electrode (source electrode) of the driving transistor T1 is $V_{PVDD}$, the difference between the voltage of the source electrode and the gate electrode of the driving transistor is $V_{sg}=V_{PVDD}-V_1=V_{PVDD}-V_{data}-|V_{th}|$, the drain current of the driving transistor T1 (that is, the driving current generated by the driving transistor T1) drives the light-emitting element 11 to emit light, and the driving current $I_d$ satisfies the following formula:

$$I_d = \frac{1}{2}\mu C_{ox}\frac{W}{L}(V_{sg}-|V_{th}|)^2 = \frac{1}{2}\mu C_{ox}\frac{W}{L}(V_{PVDD}-V_{data}+|V_{th}|-|V_{th}|)^2 = \frac{1}{2}\mu C_{ox}\frac{W}{L}(V_{PVDD}-V_{data})^2 \quad (1)$$

In the above formula, μ denotes the mobility of the carriers of the driving transistor T1, W denotes the width of the channel of the driving transistor T1, L denotes the length of the channel of the driving transistor T1, $C_{ox}$ denotes the gate oxide layer capacitance per unit area of the driving transistor T1, and $V_{PVDD}$ denotes the value of the voltage of the first power voltage signal line PVDD, that is, the voltage value of the second node N2. As shown by the formula, the driving current $I_d$ generated by the driving transistor T1 is independent of the threshold voltage $V_{th}$ of the driving transistor T1, thereby solving the display abnormality caused by the drifting of the threshold voltage of the driving transistor T1.

In addition, with reference to FIG. 6, FIG. 8, FIG. 10 and FIG. 12, one pulse of the first light-emitting signal line Emit1 covers the 3 scanning pulses of the first scanning line S1 and the 3 scanning pulses of the second scanning line S2. In this way, during the 3 initialization phases and the 3 data signal voltage writing phases at the driving transistor T1, the fourth transistor T4 and the fifth transistor T5 are turned off. If the fourth transistor T4 and the fifth transistor T5 are turned on during the initialization phases and the data signal voltage writing phases, the initialization phases and the data signal voltage writing phases cannot be effectively performed. For example, in the data signal voltage writing phase, the electric potential of the gate electrode of the driving transistor T1 is varying. If the fifth transistor is turned on in this phase, the driving current which is generated by the driving transistor T1 and flows through the light-emitting element is also varying, and the flicker may be caused.

Furthermore, continuing referring to FIG. 7 or FIG. 9, the pixel circuit of embodiment of the present disclosure further includes a reset module.

The reset module includes a seventh transistor T7. A gate electrode of the seventh transistor T7 is electrically connected to the first scanning line S1, a first electrode is electrically connected to the initialization voltage signal line Vint, and a second electrode is electrically connected to the first electrode of the light-emitting element 11. The seventh transistor T7 applies the voltage of the initialization voltage signal line Vint to the first electrode of the light-emitting element 11 in the initialization phase for initializing the electric potential of the first electrode of the light-emitting element 11, reducing the influence of the voltage of the first electrode of the light-emitting element 11 in the previous frame on the voltage of the first electrode of the light-emitting element 11 in the next frame and further improving the display uniformity.

With reference to FIG. 6, FIG. 8, FIG. 10 and FIG. 12, it can be seen that any adjacent two initialization phases have the same time interval, and any adjacent two data signal voltage writing phases have the same time interval. Therefore, two adjacent rows of pixel circuits may share the scanning line, that is, for two adjacent rows of pixel circuits, the second scanning line S2 electrically connected to the preceding row of pixel circuits is reused as the first scanning line S1 electrically connected to the next row of pixel circuits. In this way, the quantity of the scanning lines is reduced. On one hand, the material cost of the first scanning lines and the second scanning lines is saved. On the other hand, the area occupied by the first scanning lines and the second scanning lines on the array substrate is reduced. Moreover, the number of the driving circuits for providing scanning signals to the scanning lines is reduced, facilitating the narrow bezel design of the array substrate.

Note that the foregoing is merely embodiments of the present disclosure and the applied technical principles. Those skilled in the art should understand that the present disclosure is not limited to the specific embodiments described herein. Various modifications, readjustments and substitutions may be made by those skilled in the art without departing from the scope of the present disclosure. Therefore, although the present disclosure has been described in detail by way of the above embodiments, the present disclosure is not limited to the above embodiments, and may include more other equivalent embodiments without departing from the concept of the present disclosure. However, the scope of the present disclosure is determined by the scope of the appended claims.

What is claimed is:

1. A method for driving a pixel circuit, wherein the pixel circuit comprises:

a light-emitting element, a driving transistor, an initialization module, a data signal voltage writing module, a first light-emitting control module, a second light-emitting control module, a threshold compensation module, and a storage module for maintaining a voltage of a gate electrode of the driving transistor;

wherein each of a control terminal of the initialization module and a control terminal of the threshold compensation module is electrically connected to a first scanning line, wherein a control terminal of the data signal voltage writing module is electrically connected to a second scanning line, wherein a control terminal of the first light-emitting control module is electrically connected to a first light-emitting signal line, a control terminal of the second light-emitting control module is electrically connected to a second light emitting signal line;

wherein the method for driving the pixel circuit comprises a time for displaying a frame, wherein the time comprises:

a light-emitting phase, N initialization phases, and N data signal voltage writing phases before the light-emitting phase, wherein the ith of the N data signal voltage writing phases is after the ith of the N initialization phase and before the (i+1)th of the N initialization phases, wherein the Nth data signal voltage writing phase is after the Nth initialization phase, $1 \leq i \leq N-1$, i is an integer and N is an integer greater than 2;

wherein the method further comprises:

applying an initialization voltage to the gate electrode of the driving transistor by the initialization module;

applying the threshold compensation module in each of the N initialization phases, wherein in each of the N initialization phases, the first scanning line turns on the initialization module and the threshold compensation module, the second scanning line turns off the data signal voltage writing module, the first light-emitting signal line turns off the first light-emitting control module, the second light-emitting signal line turns on the second light-emitting control module;

applying a data signal voltage to the gate electrode of the driving transistor by the data signal voltage writing module, the driving transistor and the threshold compensation module in each of the N data signal voltage writing phases, wherein each of the N data signal voltage writing phases comprises a first data signal voltage writing sub-phase and a second data signal voltage writing sub-phase, wherein in the first data signal voltage writing sub-phase, the first scanning line turns on the threshold compensation module, the second scanning line turns on the data signal voltage writing module, the first light-emitting signal line turns off the first light-emitting control module, the second light-emitting signal line turns off the second light-emitting control module; and in the second data signal voltage writing sub-phase, the first scanning line turns off the initialization module, the second scanning line turns on the data signal voltage writing module, the first light-emitting signal line turns off the first light-emitting control module, the second light-emitting signal line turns off the second light-emitting control module; and generating a driving current for driving the light-emitting element to emit light by the driving transistor in the light-emitting phase.

2. The method for driving a pixel circuit according to claim 1, wherein N is set to be 3.

3. The method for driving a pixel circuit according to claim 1, wherein the applying a data signal voltage to the gate electrode of the driving transistor by the data signal voltage writing module in each of the N data signal voltage writing phases comprises:

in each of the first to the (N−1)th data signal voltage writing phases, applying a data signal voltage corresponding to a maximum brightness to the gate electrode of the driving transistor by the data signal voltage writing module; and in the Nth data signal voltage writing phase, applying a data signal voltage corresponding to a greyscale to be displayed by the data signal voltage writing module.

4. The method for driving a pixel circuit according to claim 1, wherein every two adjacent initialization phases in the N initialization phases are spaced apart by a first time interval, and every two adjacent data signal voltage writing phases in the N data signal voltage writing phases are spaced apart by a second time interval.

5. The method for driving a pixel circuit according to claim 1, wherein each of the first scanning line and the second scanning line comprises N scanning signal pulses;

wherein the first light-emitting signal line comprises at least one scanning signal pulse, wherein the at least one scanning signal pulse of the first light-emitting signal line covers the N scanning signal pulses of the first scanning line and the N scanning signal pulses of the second scanning line; and wherein the second light-emitting signal line comprises N scanning signal pulses covering respective N scanning signal pulses of the second scanning line.

6. The method for driving a pixel circuit according to claim 1, wherein the light-emitting phase comprises at least one light-emitting sub-phase and at least one turn-off phase, and wherein the method further comprises: in each of the at least one light-emitting sub-phase, turning on the first light-emitting control module and the second light-emitting control module; in each of the at least one turn-off phase, turning off either the first light-emitting control module or the second light-emitting control module.

7. The method for driving a pixel circuit according to claim 1, the threshold compensation module comprises a second transistor, the data signal voltage writing module comprises a third transistor, the first light-emitting control module comprises a fourth transistor, the second light-emitting control module comprises a fifth transistor, the initialization module comprises a sixth transistor, and the storage module comprises a first capacitor; the method comprises: a first electrode of the sixth transistor is electrically connected to an initialization voltage signal line, a second electrode of the sixth transistor is electrically connected to a first electrode of the light-emitting element, and a gate electrode of the sixth transistor is electrically connected to the first scanning line; a first electrode of the third transistor is electrically connected to a data line, a second electrode of the third transistor is electrically connected to a first electrode of the driving transistor, and a gate electrode of the third transistor is electrically connected to the second scanning line; a first electrode of the second transistor is electrically connected to a second electrode of the driving transistor, a second electrode of the second transistor is electrically connected to the gate electrode of the driving transistor, and a gate electrode of the second transistor is electrically connected to the second scanning line; a first electrode of the fourth transistor is electrically connected to a first power voltage signal line, a second electrode of the fourth transistor is electrically connected to the first electrode of the driving transistor, and a gate electrode of the fourth transistor is electrically connected to the first light-emitting signal d; a first electrode of the fifth transistor is electrically connected to the second electrode of the driving transistor, a second electrode of the fifth transistor is electrically connected to the first electrode of the light-emitting element, and a gate electrode of the fifth transistor is electrically connected to the second light-emitting signal line; a first electrode of the first capacitor is electrically connected to the gate electrode of the driving transistor, and a second electrode of the first capacitor is electrically connected to the first power voltage signal line; and a second electrode of the light-emitting element is electrically connected to a second power voltage signal line.

8. The method for driving a pixel circuit according to claim 5, wherein for two adjacent rows of pixel circuits, the second scanning line electrically connected to a preceding one of the two adjacent rows of pixel circuits is reused as the first scanning line electrically connected to a subsequent one of the two adjacent rows of pixel circuits.

9. A method for driving a pixel circuit, wherein the pixel circuit comprises a light-emitting element, a driving transistor, an initialization module, a data signal voltage writing module, and a storage module for maintaining a voltage of a gate electrode of the driving transistor, Wherein the method comprises a time for displaying a frame, wherein the time comprises:

a light-emitting phase, N initialization phases, and N data signal voltage writing phases before the light-emitting phase, wherein the ith of the N data signal voltage writing phases occurs after the ith of the N initialization phase and before the (i+1)th of the N initialization phases, and wherein the Nth data signal voltage writing phase occurs after the Nth initialization phase, $1 \leq i \leq N-1$, i is an integer and N is an integer greater than 2;

wherein the method further comprises:

applying an initialization voltage to the gate electrode of the driving transistor by the initialization module in each of the N initialization phases, wherein the first light emitting control voltage occurs before the initialization voltage occurs;

applying a data signal voltage to the gate electrode of the driving transistor by the data signal voltage writing module in each of the N data signal voltage writing phases; and generating a driving current for driving the light-emitting element to emit light by the driving transistor in the light-emitting phase;

wherein the pixel circuit further comprises a first light-emitting control module configured to control the light-emitting element to emit light;

wherein the method further comprises turning off the first light-emitting control module in the N initialization phases and N data signal voltage writing phases;

wherein the pixel circuit further comprises a threshold compensation module and a second light-emitting control module, wherein the threshold compensation module comprises a second transistor, wherein the data signal voltage writing module comprises a third transistor, wherein the first light-emitting control module comprises a fourth transistor, the second light-emitting control module comprises a fifth transistor, wherein the initialization module comprises a sixth transistor, and wherein the storage module comprises a first capacitor;

wherein the method further comprises:

a first electrode of the driving transistor is electrically connected to a first power voltage signal line, and a first electrode of the first capacitor is electrically connected to the gate electrode of the driving transistor;

a first electrode of the sixth transistor is electrically connected to an initialization voltage signal line, a second electrode of the sixth transistor is electrically connected to the gate electrode of the driving transistor, and a gate electrode of the sixth transistor is electrically connected to a first scanning line;

a first electrode of the second transistor is electrically connected to a second electrode of the driving transistor, a second electrode of the second transistor is electrically connected to the gate electrode of the driving transistor, and a gate electrode of the second transistor is electrically connected to a second scanning line;

a first electrode of the third transistor is electrically connected to a data line, a second electrode of the third transistor is electrically connected to a second electrode of the first capacitor, and a gate electrode of the third transistor is electrically connected to the second scanning line;

a first electrode of the fourth transistor is electrically connected to one of the first power voltage signal line and a first reference voltage signal line, a second electrode of the fourth transistor is electrically connected to a second electrode of the first capacitor, and a gate electrode of the fourth transistor is electrically connected to a first light-emitting signal line;

a first electrode of the fifth transistor is electrically connected to the second electrode of the driving transistor, a second electrode of the fifth transistor is electrically connected to a first electrode of the light-emitting element, and a gate electrode of the fifth transistor is electrically connected to a second light-emitting line; and a second electrode of the light-emitting element is electrically connected to a second power voltage signal line.

10. The method for driving a pixel circuit according to claim 9, wherein the pixel circuit further comprises a reset module, wherein the reset module comprises a seventh transistor, wherein a gate electrode of the seventh transistor is electrically connected to the first scanning line, a first electrode of the seventh transistor is electrically connected to the initialization voltage line, and a second electrode of the seventh transistor is electrically connected to the first electrode of the light-emitting element.

* * * * *